US008939624B2

(12) United States Patent
Yamamoto et al.

(10) Patent No.: US 8,939,624 B2
(45) Date of Patent: Jan. 27, 2015

(54) LIGHTING UNIT AND VEHICULAR LIGHTING APPARATUS

(71) Applicants: Ippei Yamamoto, Shizuoka (JP); Hiroki Matsumoto, Shizuoka (JP); Ryuho Sato, Shizuoka (JP)

(72) Inventors: Ippei Yamamoto, Shizuoka (JP); Hiroki Matsumoto, Shizuoka (JP); Ryuho Sato, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 153 days.

(21) Appl. No.: 13/749,212

(22) Filed: Jan. 24, 2013

(65) Prior Publication Data

US 2013/0188378 A1 Jul. 25, 2013

(30) Foreign Application Priority Data

Jan. 24, 2012 (JP) ..... 2012-012011

(51) Int. Cl.

| | |
|---|---|
| ***F21V 17/02*** | (2006.01) |
| ***F21V 13/04*** | (2006.01) |
| ***F21S 8/10*** | (2006.01) |
| *F21V 13/14* | (2006.01) |

(52) U.S. Cl.

CPC ..... *F21V 13/04* (2013.01); *F21S 48/1159* (2013.01); *F21S 48/1388* (2013.01); *F21S 48/1747* (2013.01); *F21S 48/1757* (2013.01); *F21S 48/1784* (2013.01); *F21V 13/14* (2013.01)

USPC ..... 362/512; 362/539

(58) Field of Classification Search

CPC ..... F21S 48/1778; F21S 48/1388; F21S 48/1159; F21S 48/1757

USPC ..... 362/512, 539, 543, 243

See application file for complete search history.

(56) References Cited

U.S. PATENT DOCUMENTS

| | | | | |
|---|---|---|---|---|
| 5,422,792 | A | 6/1995 | Neumann | |
| 7,865,872 | B2 * | 1/2011 | Chamieh et al. | 717/108 |
| 8,104,940 | B2 * | 1/2012 | Ochiai | 362/512 |
| 2010/0135037 | A1 | 6/2010 | Tsukamoto | |
| 2010/0309678 | A1 | 12/2010 | Yamagata | |
| 2010/0309680 | A1 | 12/2010 | Akutagawa et al. | |
| 2012/0014125 | A1 | 1/2012 | Uchida | |

FOREIGN PATENT DOCUMENTS

| | | |
|---|---|---|
| CN | 202118743 U | 1/2012 |
| EP | 2354644 A1 | 8/2011 |
| EP | 2407710 A2 | 1/2012 |

(Continued)

OTHER PUBLICATIONS

English Patent Abstract of JP 2010-135076; from esp@cenet, Dated Jun. 17, 2010 (1 Page).

(Continued)

*Primary Examiner* — Vip Patel
(74) *Attorney, Agent, or Firm* — Osha Liang LLP

(57) ABSTRACT

A lighting unit includes a first light source, a second light source, a projection lens, a first reflector that reflects light from the first light source, a second reflector that reflects light from the second light source, a shade section, and a reflecting section. The shade section is movable between a first position at which at least a part of the light from the second reflector is shielded and a second position which is spaced apart from the first position. The reflecting section reflects a part of the light reflected from the second reflector when the shade section is at the first position.

8 Claims, 4 Drawing Sheets

(56) References Cited

FOREIGN PATENT DOCUMENTS

| | | | |
|---|---|---|---|
| JP | 4289268 | B2 | 7/2009 |
| JP | 2010-135076 | A | 6/2010 |

OTHER PUBLICATIONS

Office Action issued in corresponding Chinese Application No. 201310027727.4 dated Sep. 23, 2014, and English translation thereof (17 pages).

* cited by examiner

LIGHTING UNIT AND VEHICULAR LIGHTING APPARATUS

BACKGROUND OF THE INVENTION

1. Field of the Invention

The present invention relates to a lighting unit and a vehicular lighting apparatus.

2. Related Art

A lighting unit described in JP-A-2010-135076 has a pair of reflectors respectively having openings, and the reflectors are disposed at upper and lower positions on both sides of an optical axis of a projection lens so as to face each other. LED devices are disposed in the respective openings of the reflectors. The LED devices are disposed in the upper and lower reflectors which are positioned on both sides of the optical axis of the lighting unit so as to face each other, so that light that is radiated therefrom is reflected by the respective reflectors and projected onto a projection lens disposed in a front side.

This configuration makes it possible to guide an optical flux from the LED devices which are disposed up and down toward the projection lens without losses. In addition, since the LED devices are disposed up and down and spaced apart from each other, it is scarce that these devices are thermally influenced by each other when they generate heat. Accordingly, it is possible to reduce the influence of heat to the value of light flux of the LED devices.

When the lighting unit of JP-A-2010-135076 is applied to a headlight of a vehicle, a light distribution pattern for entire irradiation and a light distribution pattern for a high beam may be formed using light reflected from the upper and lower reflectors. In order to form only a low beam, a part of the light distribution pattern for entire irradiation may be shielded by a means such as a shade. However, when the reflection light is simply shielded in this fashion, a utilization rate of a light flux is lowered.

SUMMARY OF THE INVENTION

One or more embodiments of the invention provide a lighting unit in which a plurality of LED devices are used and a utilization rate of a light flux is not lowered irrespective of switching of a light distribution pattern.

In accordance with one or more embodiments of the invention, a lighting unit includes: a first light source; a second light source; a projection lens; a first reflector that reflects light generated by the first light source toward a first area of the projection lens; a second reflector that reflects light generated by the second light source toward a second area on the projection lens, the second area including at least a part of the first area; a shade section disposed to be movable between a first position at which at least a part of the light which is incident onto the first area from the second reflector is shielded and a second position which is spaced apart from the first position; and a reflecting section that reflects and guides a part of the light reflected from the second reflector to a region within the second area when the shade section is at the first position.

DETAILED DESCRIPTION OF THE EMBODIMENTS

Embodiments of the invention are described with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
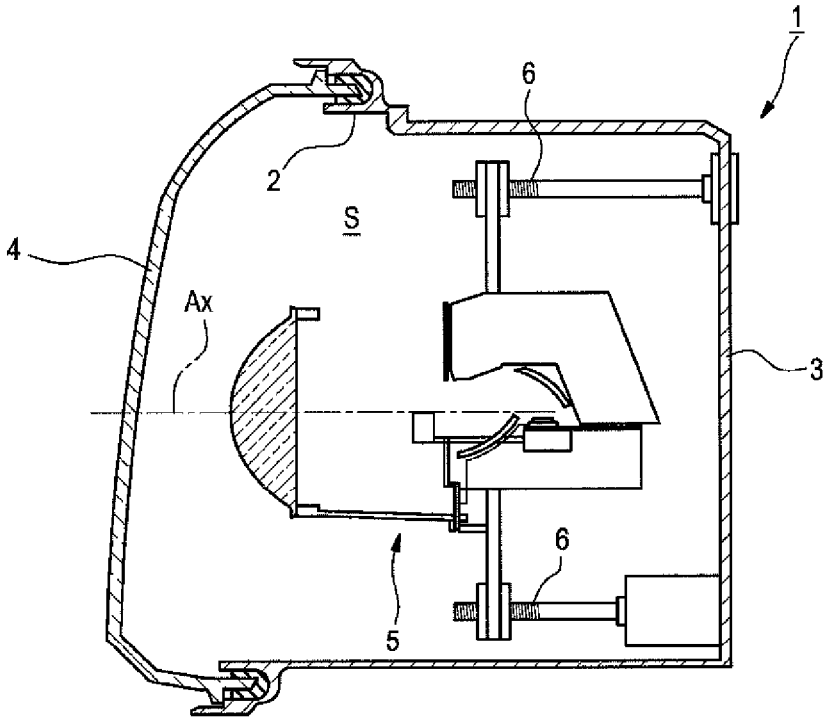
FIG. 1 is a longitudinal cross-sectional view of a vehicular lighting apparatus according to one or more embodiments of the present invention.

FIG. 1 is a longitudinal cross-sectional view of a vehicular lighting apparatus 1 according to one or more embodiments of the present invention. The vehicular lighting apparatus 1 is used as a headlight of a vehicle such as an automobile or a motorcycle. The vehicular lighting apparatus 1 generally includes a lamp body 3 having an opening 2, a light-transmitting cover 4 which covers the opening 2, and a lighting unit 5 which is disposed inside a lamp chamber S defined by the lamp body 3 and the light-transmitting cover 4. The lighting unit 5 is supported on the lamp body 3 via an aiming mechanism 6 which is fixed to the lamp body 3, and is configured such that the direction of the optical axis Ax thereof can be adjusted by adjusting the aiming mechanism 6.

Figure 2:
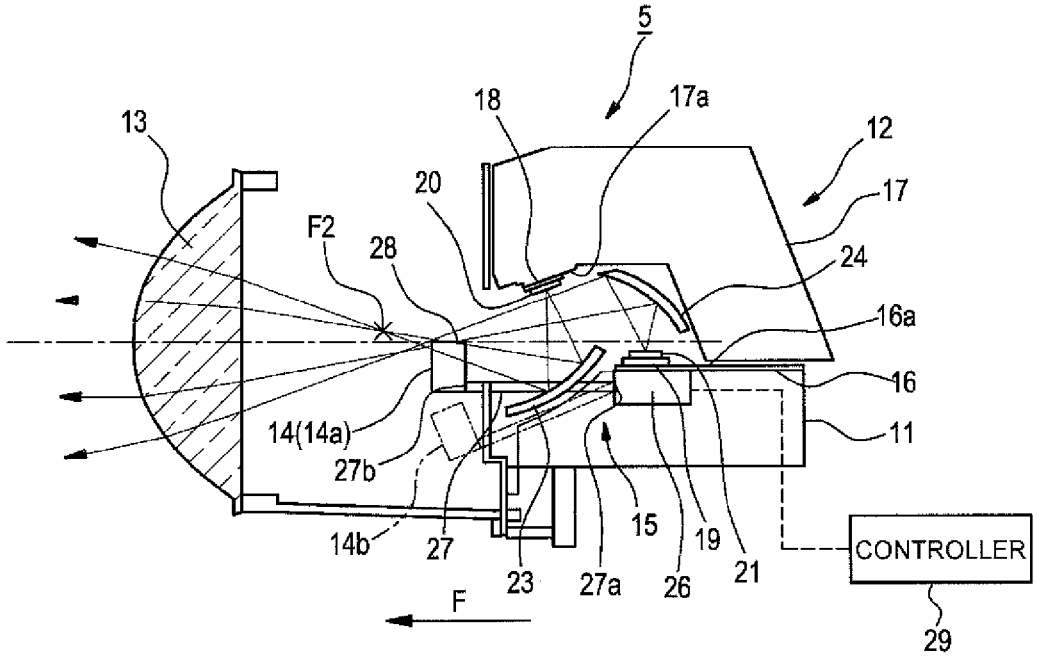
FIG. 2 is a longitudinal cross-sectional view enlarging a lighting unit shown in FIG. 1.
Figure 3:
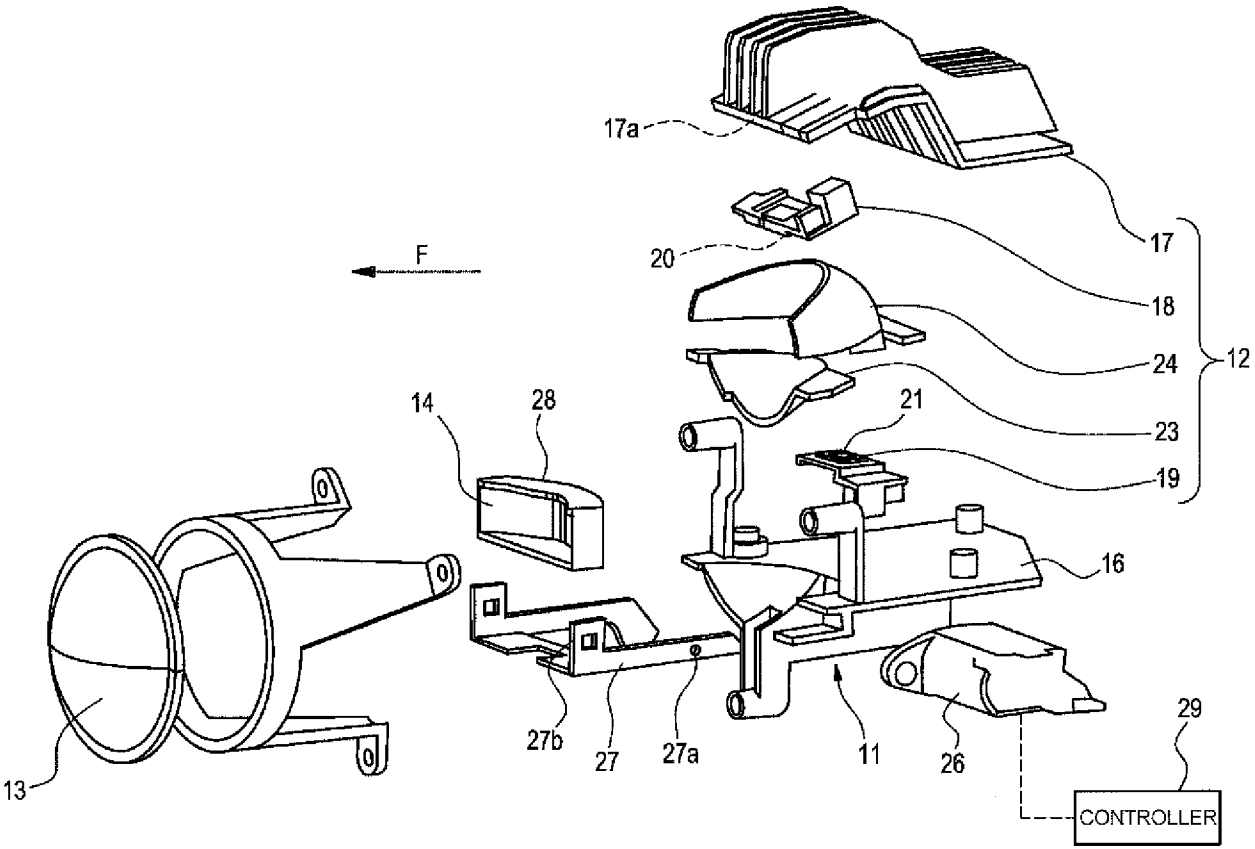
FIG. 3 is an exploded perspective view enlarging the lighting unit shown in FIG. 1.

FIG. 2 is a longitudinal cross-sectional view enlarging the lighting unit 5, and FIG. 3 is an exploded perspective view of the lighting unit 5. As shown in the figures, the lighting unit 5 includes a support bracket 11 which is supported by the lamp body 3 (see FIG. 1), a light source unit 12 which is supported by the support bracket 11, a projection lens 13 which is supported by the support bracket 11, is disposed at a position F in front of the light source unit 12, and is implemented as a planoconvex lens, and a shade mechanism 15 which has a beam shaper (shade section) 14 which can be disposed between the light source unit 12 and the projection lens 13.

The light source unit 12 includes a heat-dissipating section 17, a first LED board 18 and a second LED board 19. The heat-dissipating section 17 is attached to an upper plate 16 of the support bracket 11 which is substantially horizontally disposed, and is fixed on the upper plate 16. The first LED board 18 is attached to the underside surface 17*a* of the heat-dissipating section 17. The second LED board 19 is attached to the upper surface 16*a* of the upper plate 16. A first LED device (first light source) 20 which acts as a light source for a high beam is mounted on the first LED board 18, and a second LED device (second light source) 21 which acts as a light source for a low beam is mounted on the second LED board 19. In addition, a first reflector 23 which reflects and guides light irradiated from the first LED device 20 to the projection lens 13 is disposed on the upper plate 16, at a position that is opposite the first LED substrate 18. A second reflector 24 which reflects and guides light irradiated from the second LED device 21 to the projection lens 13 is disposed on the upper plate 16, at a position which covers the second LED board 19. Both the first and second reflectors 23 and 24 have a rotary elliptical surface, the first LED device 20 is disposed at a position adjacent to one focus of the first reflector 20, and the second LED device 21 is disposed at a position adjacent to one focus of the second reflector 24. In addition, the first and second reflectors 23 and 24 are positioned at different positions along the optical axis Ax.

The shade mechanism 15 includes a motor 26 attached to the support bracket 11 and an arm 27 having a fulcrum 27*a* thereof attached to the motor 26. A beam shaper 14 is disposed on a leading end section 27*b* of the arm 27. As shown in FIG. 2, the arm 27 is configured so as to be rotatable about the fulcrum 27*b* in response to operation of the motor 26. Accordingly, the beam shaper 14 is configured so as to be movable between a first position 14*a* which is shown in solid lines between the light source unit 12 and the projection lens 13 and a second position 14*b* which is shown in chin lines spaced apart from the first position 14*a*. The beam shaper 14 extends across the optical axis Ax of the lighting unit 5 at the first position 14*a*, and thereby functions to block a part of light irradiated from the light source unit 12.

In addition, the upper surface of the beam shaper 14 is configured as a reflecting section 28 which can reflect irradiation light. The reflecting section 28 is disposed such that it is positioned to extend in the direction parallel to the optical axis Ax when the beam shaper 14 is at the first position 14*a*. In this case, the position of the reflecting section 28 is adjusted to be adjacent to the other focus F2 of the second reflector 28.

In addition, the motor 26 is connected to a controller 29. The beam shaper 14 can move between the first position 14*a* and the second position 14*b* based on an input signal from the controller 29, thereby mechanically opening and closing the shade mechanism 15.

Below, a description is given of a path of light irradiated from the lighting unit 5.

Figure 4:
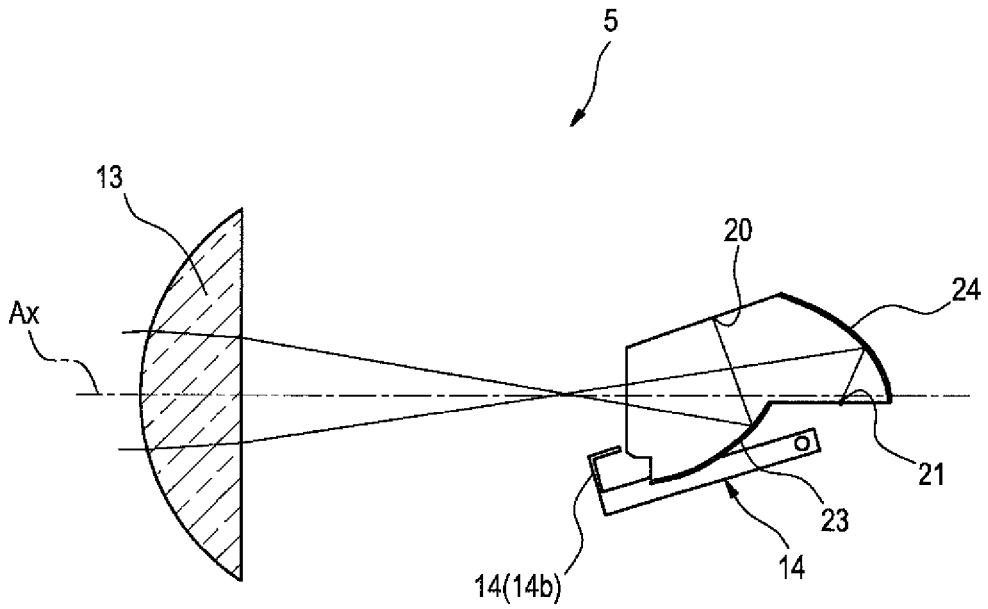
FIG. 4 is an optical path diagram in a situation that a shade mechanism is opened in the lighting unit in FIG. 2.

FIG. 4 is a schematic diagram showing the path of light irradiated from the lighting unit 5 when the shade mechanism 15 of the lighting unit 5 is opened, i.e., the beam shaper 14 is at the second position 14*b* spaced apart from the optical axis Ax.

As shown in the figure, when the shade mechanism 15 is opened, light generated from the first LED device 20 is guided onto the projection lens 13 by being reflected by the first reflector 23. An irradiation area (first area) on the projection lens 13 that is irradiated by irradiation light from the first LED device 20 is indicated by reference numeral 30 in FIG. 5.

Meanwhile, light generated from the second LED device 21 is guided onto the projection lens 13 by being reflected by the second reflector 24. The second reflector 24 is configured such that the diameter thereof as the rotary elliptical surface becomes greater than the first reflector 23. Consequently, an irradiation area (second area) on the projection lens 13 that is irradiated by irradiation light from the second LED device 21 is an area that includes the irradiation area 30 which is irradiated by the first LED device 20 and a surrounding area 32 around the irradiation area 30.

Figure 5:
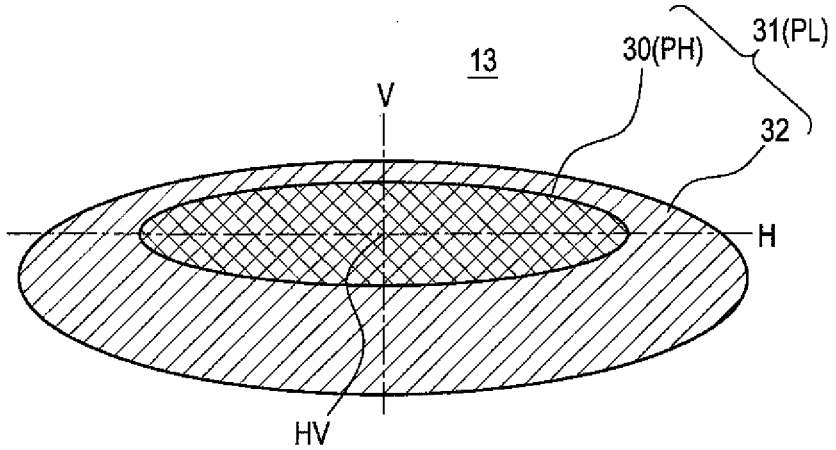
FIG. 5 is a schematic view showing an irradiation area on a projection lens and a light distribution pattern on a virtual vertical screen in the situation of FIG. 4.

In addition, the irradiation areas 30 and 31 shown in FIG. 5 are directly projected as light distribution patterns onto a virtual vertical screen disposed at a predetermined position in front of the vehicle. Specifically, the irradiation area 30 generated by the first LED device 20 is projected forward of the vehicle as a high-beam distribution pattern PH around an elbow point HV in front of the lighting device. In addition, the irradiation area 31 generated by the second LED device is projected forward of the vehicle as a low-beam distribution pattern PL that expands downward of a horizontal line H-H that passes through the elbow point HV. In this case, the low-beam distribution pattern PL and the high-beam distribution pattern PH overlap each other. Consequently, for the high-beam distribution pattern PH, light that is irradiated from the first reflector 23 at the lower position overlaps light that is irradiated from the second reflector 24 at the upper position. It is therefore possible to realize a high beam having a high intensity of light.

Figure 6:
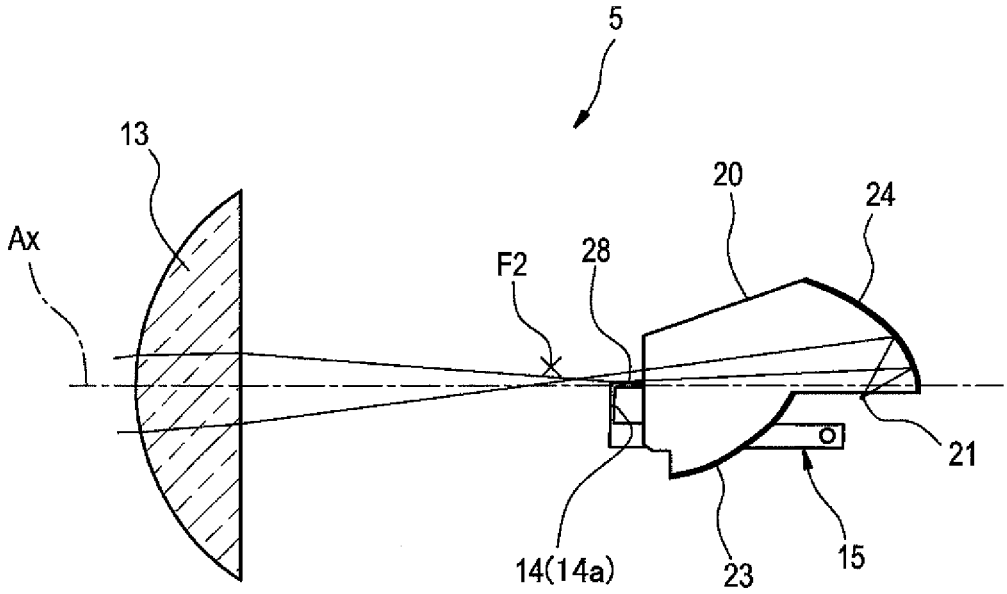
FIG. 6 is an optical path diagram in a situation that the shade mechanism is closed in the lighting unit in FIG. 2.

Meanwhile, an optical path when the shade mechanism 15 is closed, i.e. when the beam shaper 14 is at the first position 14*a* between the light source unit 12 and the projection lens 13, is shown in FIG. 6. As shown in the figure, when the beam shaper 14 is at the first position, the beam shaper 14 is positioned in front of the first reflector 23, and a part of light that is generated from the second LED device 21 and reflected by the second reflector 24 is shielded by the beam shaper 14. Consequently, as shown in FIG. 7, a cutoff line CL is formed on the virtual vertical screen in front of the vehicle, below a horizontal line H-H.

Figure 7:
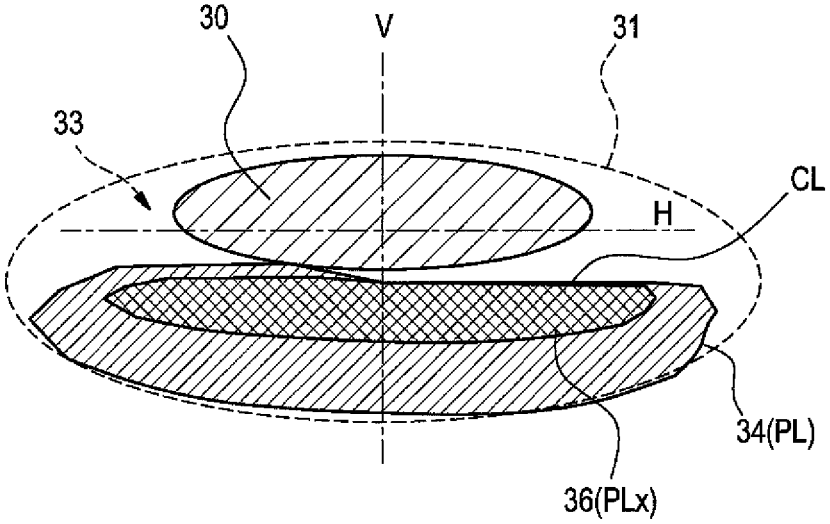
FIG. 7 is a schematic view showing an irradiation area on the projection lens and a light distribution pattern on the virtual vertical screen in the situation of FIG. 6.

In this case, as shown in FIG. 7, a shade area 33 in which irradiation light is shielded on the projection lens 13 by the beam shaper 14 includes the high-beam irradiation area 30 (see FIG. 5), and a portion of the low-beam irradiation area 31 that excludes the shade area 33 is formed as an irradiation area 34 into which light reflected from the second reflector 24 is incident.

When the shade mechanism 15 is closed like this, the utilization rate of light flux is lowered since all of light reflected from the first reflector 23 and about half of light reflected from the second reflector 24 are shielded. However, in one or more embodiments of the present invention, the reflecting section 28 acts to guide a part of the reflection light that is reflected from the second reflector 24 and shielded by the beam shaper 14 to the projection lens 13, thereby preventing the utilization rate of light flux from lowering. Specifically, as shown in FIG. 6, when the beam shaper 14 is at the first position 14*a*, a part of the light reflected from the second reflector 24 is incident into the reflecting section 28 which is disposed adjacent to the focus F2 of the second reflector 24. The reflecting section 28 guides it to a reflected area 36 (see FIG. 7), i.e. a portion of the surrounding area 32 of the low-beam irradiation area (see FIG. 5) that excludes the high-beam irradiation area 30. The reflected area 36 is projected as a greater-intensity-of-light area PLx below the line H-H of a low-beam distribution area PL on the virtual vertical screen, since both the reflection light that is directly input from the second reflector 24 and the reflection light that is input from the reflecting section 28 is incident. Since the greater-intensity-of-light area PLx is formed, it is possible to switch the light distribution pattern from a high beam into a low beam without lowering the intensity of light.

As described above, the lighting unit 5 of one or more embodiments of the present invention is provided with the reflecting section 28 which reflects a part of incident light which is directed to the irradiation area 31 from the second reflector 24 and is to be shielded by the beam shaper 14 and guides it to the reflected area 36, i.e. a portion of the irradiation area 31, when the beam shaper 14 is at the first position 14*a*. When the shade mechanism 15 is closed, it is possible to guide a part of the incident light from the second reflector 24 to the projection lens 13. Accordingly, it is possible to realize an efficient vehicular lighting apparatus because the fight distribution pattern can be switched from a high beam into a low beam without decreasing the utilization rate of light flux.

In addition, the beam shaper 14 extends in the direction across the optical axis Ax when the beam shaper 14 is at the first position 14*a*. The reflecting section 28 extends in the direction parallel to the optical axis Ax when the beam shaper 14 is at the first position 14*a*. This makes it possible to realize the shade mechanism 15 and the reflecting section 28 using a simple structure.

In addition, since the reflector 28 is positioned adjacent to the focus of the second reflector 24 when the beam shaper 14 is at the first position 14*a*, a light beam that is incident into the reflecting section 28 from the second reflector 24 can be converged adjacent to the reflecting section 28, thereby increasing the efficiency of utilization of light.

Furthermore, in the lighting unit 5 of one or more embodiments of the present invention, the first LED device 20 is disposed at the side of the second reflector 24 with respect to the optical axis Ax, and the second LED device 21 is disposed at the side of the first reflector 23 with respect to the optical axis Ax. This makes it possible to dispose the first and second reflectors 23 and 24 on both sides of the optical axis Ax so as to face each other, thereby realizing a large-area reflector optical system having a compact design in a limited space.

In addition, since the irradiation area 31 which is irradiated by the second LED device 21 includes the irradiation area 30 of the first LED device 20 and the surrounding area 32 thereof, it is possible to use the irradiation area 30 to be suitable for a high-beam distribution pattern and the irradiation area 31 to be suitable for a low-beam distribution pattern.

Furthermore, since the first reflector 23 and the second reflector 24 are positioned at different directions toward the optical axis Ax, it is possible to prevent the position of the first LED device 20 and the position of the second reflector 24 from interrupting each other and the position of the second LED device 21 and the position of the first reflector 23 from interrupting each other. Accordingly, it is not required to form an opening in the reflector in order to dispose the LED device, and the efficiency of utilization of reflection light is high.

Although embodiments of the present invention have been described above as an example, the present invention is not limited to the above embodiments, and can employ other forms without departing from the scope of the present invention.

For example, although the LED device was used as the light source in one or more of the foregoing embodiments, this is not intended to be limiting but other light-emitting elements or bulbs can be used.

In addition, although the shade mechanism 15 is driven by the motor 26 in one or more of the foregoing embodiments, this is not intended to be limiting but the shade mechanism can be driven using a solenoid or the like.

Furthermore, although the first reflector 23 and the second reflector 24 are disposed at different positions along the axis Ax, this is not intended to be limiting but they can be disposed at the same position.

In addition, although reflection light from the first reflector 23 and reflection light from the second reflector 24 are used as a high beam and a low beam, respectively, this is not intended to be limiting but the opposite configuration can be employed. It is also possible to form a different light distribution pattern using the reflection light.

In addition, other structures and materials or the like can of course be employed without departing from the scope of the present invention, and be suitably and selectively used.

In accordance with embodiments, a lighting unit 5 may include: a first light source 20; a second light source 21; a projection lens 13; a first reflector 23 that reflects light generated by the first light source 20 toward a first area 30 of the projection lens 13; a second reflector 24 that reflects light generated by the second light source 21 toward a second area 31 on the projection lens 13, the second area 31 including at least a part of the first area 30; a shade section 14 disposed to be movable between a first position 14*a* at which at least a part of the light which is incident onto the first area 30 from the second reflector 24 is shielded and a second position 14*b* which is spaced apart from the first position 14*a*; and a reflecting section 28 that reflects and guides a part of the light reflected from the second reflector 24 to a region 36 within the second area 31 when the shade section 14 is at the first position 14*a*.

According to this structure, when changing the irradiation area by driving the shade, a part of the light that is incident into the first area from the second reflector can be guided to the projection lens without being shielded by the shade.

In the above structure, the shade section 14 may extend in a direction across an optical axis Ax when the shade section 14 is at the first position 14*a*. The reflecting section 28 may extend in a direction parallel to the optical axis Ax when the shade section 14 is at the first position 14*a*.

According to this structure, the shade section and the reflecting section can be realized in a simple structure.

In the above structure, the reflecting section 28 may position adjacent to a focus F2 of the second reflector 24 when the shade section 14 is at the first position 14*a*.

According to this structure, the reflection light that is incident into the reflecting section from the second reflector can be converged.

In the above structure, the first reflector 23 and the second reflector 24 may be disposed such that the optical axis Ax passes between the first reflector 23 and the second reflector 24. The first light source 20 may be disposed at a side of the second reflector 24 with respect to the optical axis Ax. The second light source 21 may be disposed at a side of the first reflector 23 with respect to the optical axis Ax.

According to this structure, the first and second reflectors can be disposed on both sides of the optical axis so as to face each other.

In the above structure, the second area 31 may be formed around the first area 30.

According to this structure, the first area that is irradiated by the first light source can be set as a high-beam irradiation area, and the second area that is irradiated by the second light source can be set as a low-beam irradiation area.

In the above structure, the first reflector 23 may be disposed in a position different from the second reflector 24 in the direction of the optical axis Ax.

According to this structure, it is possible to prevent the position of the first light source and the position of the second reflector from interrupting each other and the position of the second light source and the position of the first reflector from interrupting each other.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A lighting unit comprising:

a first light source;

a second light source;

a projection lens;

a first reflector that reflects light generated by the first light source toward a first area of the projection lens;

a second reflector that reflects light generated by the second light source toward a second area on the projection lens, the second area including at least a part of the first area;

a shade section disposed to be movable between a first position at which at least a part of the light which is incident onto the first area from the second reflector is shielded and a second position which is spaced apart from the first position; and a reflecting section that reflects and guides a part of the light reflected from the second reflector to a region within the second area when the shade section is at the first position.

2. The lighting unit according to claim 1, wherein the shade section extends in a direction across an optical axis when the shade section is at the first position, and wherein the reflecting section extends in a direction parallel to the optical axis when the shade section is at the first position.

3. The lighting unit according to claim 1, wherein the reflecting section positions adjacent to a focus of the second reflector when the shade section is at the first position.

4. The lighting unit according to claim 3, wherein the first reflector and the second reflector are disposed such that the optical axis passes between the first reflector and the second reflector, wherein the first light source is disposed at a side of the second reflector with respect to the optical axis, and wherein the second light source is disposed at a side of the first reflector with respect to the optical axis.

5. The lighting unit according to claim 1, wherein the second area is an area that is formed around the first area.

6. The lighting unit according to claim 1, wherein the first reflector is disposed in a position different from the second reflector in a direction of an optical axis.

7. A vehicular lighting apparatus comprising:

a lamp body having an opening;

a lamp cover, wherein the lamp cover covers the opening and a lamp chamber is defined between the lamp cover and the lamp body; and the lighting unit according to claim 1, wherein the lighting unit is disposed within the lamp chamber.

8. A lighting unit comprising:

a first light source;

a second light source;

a projection lens;

a first reflector that reflects light generated by the first light source toward a first area of the projection lens;

a second reflector that reflects light generated by the second light source toward a second area on the projection lens, the second area including at least a part of the first area;

a shade section disposed to be movable between a first position at which at least a part of the light which is incident onto the first area from the second reflector is shielded and a second position which is spaced apart from the first position; and a reflecting section that reflects and guides a part of the light reflected from the second reflector to a region within the second area when the shade section is at the first position, wherein the shade section extends in a direction across an optical axis when the shade section is at the first position, wherein the reflecting section extends in a direction parallel to the optical axis when the shade section is at the first position, wherein the reflecting section positions adjacent to a focus of the second reflector when the shade section is at the first position, wherein the first reflector and the second reflector are disposed such that the optical axis passes between the first reflector and the second reflector, wherein the first light source is disposed at a side of the second reflector with respect to the optical axis, wherein the second light source is disposed at a side of the first reflector with respect to the optical axis, wherein the second area is an area that is formed around the first area, and wherein the first reflector is disposed in a position different from the second reflector in a direction of the optical axis.

* * * * *